US010766273B2

(12) United States Patent
Nakashima

(10) Patent No.: US 10,766,273 B2
(45) Date of Patent: Sep. 8, 2020

(54) THERMAL PRINTER AND METHOD FOR CONTROLLING THE THERMAL PRINTER

(71) Applicant: Mitsubishi Electric Corporation, Tokyo (JP)

(72) Inventor: So Nakashima, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/470,484

(22) PCT Filed: Jan. 31, 2017

(86) PCT No.: PCT/JP2017/003313

§ 371 (c)(1),
(2) Date: Jun. 17, 2019

(87) PCT Pub. No.: WO2018/142446

PCT Pub. Date: Aug. 9, 2018

(65) Prior Publication Data

US 2020/0114656 A1 Apr. 16, 2020

(51) Int. Cl.
*B41J 2/31* (2006.01)
*B41J 2/325* (2006.01)
(Continued)

(52) U.S. Cl.
CPC ..... *B41J 2/325* (2013.01); *B41J 2/33505* (2013.01); *B41J 35/18* (2013.01); *B41J 2202/30* (2013.01)

(58) Field of Classification Search
CPC ..... B41J 2/312; B41J 2/325; B41J 2/33505; B41J 35/18
See application file for complete search history.

(56) References Cited

U.S. PATENT DOCUMENTS 8,503,026 B2 8/2013 Kaechi
2008/0286024 A1* 11/2008 Kajihara ..... G06F 3/1219 400/76
(Continued)

FOREIGN PATENT DOCUMENTS

EP 3 339 040 A1 6/2018
JP 2004-82610 A 3/2004
(Continued)

OTHER PUBLICATIONS

International Search Report issued in PCT/JP2017/003313 (PCT/ISA/210), dated Apr. 11, 2017.
(Continued)

*Primary Examiner* — Lamson D Nguyen
(74) *Attorney, Agent, or Firm* — Birch, Stewart, Kolasch & Birch, LLP

(57) ABSTRACT

An object is to improve image quality in panoramic printing using a thermal printer. The thermal printer includes a seam shape calculator and a controller. The seam shape calculator determines the position and shape of a seam between images on the basis of an index of inconspicuousness to human eyes, in panorama printing where a panoramic image longer than a specified printing size is divided into the images as small as or smaller than the printing size, and is printed multiple times so that the images are joined to each other. The controller controls a printing medium, an ink ribbon, and a thermal head so that the images divided based on the position and shape of the seam are thermally transferred onto respective continuous regions of the printing medium using unit printing regions of the ink ribbon, so as to be joined to each other.

11 Claims, 5 Drawing Sheets

(51) Int. Cl.
*B41J 2/335* (2006.01)
*B41J 35/18* (2006.01)

(56) References Cited

U.S. PATENT DOCUMENTS

| | | | | |
|---|---|---|---|---|
| 2013/0016172 | A1 | 1/2013 | Furuki et al. | |
| 2017/0210143 | A1* | 7/2017 | Yamazaki | B41J 2/36 |
| 2018/0264842 | A1 | 9/2018 | Abe | |

FOREIGN PATENT DOCUMENTS

| | | | |
|---|---|---|---|
| JP | 2010-188627 | A | 9/2010 |
| JP | 5349684 | B2 | 11/2013 |
| JP | 5366585 | B2 | 12/2013 |
| JP | 2016-182783 | A | 10/2016 |
| JP | 6104488 | B1 | 3/2017 |

OTHER PUBLICATIONS

Extended European Search Report dated Dec. 16, 2019, for corresponding European Application No. 17894817.0.
Chinese Office Action and Search Report, dated May 7, 2020, for Chinese Application No. 201780084531.5, with an English translation.

* cited by examiner

THERMAL PRINTER AND METHOD FOR CONTROLLING THE THERMAL PRINTER

TECHNICAL FIELD

The present invention relates to thermal printers and methods for controlling the thermal printers. More specifically, the present invention relates to a thermal printer that performs panorama printing, and to a method for controlling the thermal printer.

BACKGROUND ART

Some thermal printers print images by thermally transferring the inks of an ink ribbon onto a printing medium, such as a paper roll, with a thermal head. In such a thermal printer, the paper roll, when used as a printing medium, has an unlimited length in its transfer direction (also referred to as the "vertical scanning direction"). On the other hand, the ink ribbon contains, for instance, a yellow (Y) ink, a magenta (M) ink, a cyan (C) ink, and an OP (i.e., coating) ink each having a specified size. The ink sizes thus limit a printing size. Accordingly, the ink ribbon needs to be changed in conformance with a desired printing size.

Printing an image that is long in the vertical scanning direction, such as a panoramic image, requires an ink ribbon in conformance with a long printing size. Such ink ribbons are unfortunately less available and thus expensive.

To address this problem, panorama printing is provided that is a means for printing an image longer than an ink ribbon of specified printing size, such as a panoramic image. In the panorama printing, the panoramic image is divided to be printed in combination with the ink ribbon of specified printing size. Dividing the panoramic image into a plurality of images as small as or smaller than the printing size of the ink ribbon enables printing with the ink ribbon of specified printing size. Further, printing the panoramic image multiple times so as to join the divided images together provides a single printed image. In the printing by joining the divided images together, printing with the images partly overlapping each other without any processing produces a conspicuous seam. This unfortunately degrades the quality of the printed image.

To address this problem, Patent Document 1, for instance, describes reducing the difference in concentration between the images at the seam, thus improving the image quality. Moreover, Patent Document 2 describes improving the image quality by individually changing, at the seam, the correction of a portion to be printed first and the correction of a portion to be printed later so that the concentration of the portion at the seam is uniform.

PRIOR ART DOCUMENTS

Patent Documents

Patent Document 1: Japanese Patent Application Laid-Open No. 2004-82610

Patent Document 2: Japanese Patent No. 5349684

SUMMARY

Problem to be Solved by the Invention

The methods in Patent Documents 1 and 2 produce a panoramic image that consists of images joined together at a linear seams, no matter what kind of image the panoramic image is. Thus, the linear seam in panorama printing possibly appears at a location conspicuous to human eyes.

To solve this problem, it is an object of the present invention to provide a thermal printer that, in panorama printing, renders a seam inconspicuous to human eyes and improves image quality. It is another object of the present invention to provide a method for controlling the thermal printer.

Means to Solve the Problem

An aspect of the present invention provides a thermal printer that performs printing by thermally transferring an ink of an ink ribbon onto a printing medium using a thermal head. The ribbon includes a plurality of unit printing regions each provided with the ink in a unit of a specified printing size. The thermal printer includes a seam shape calculator, a controller, a temperature sensor, and a temperature-and-humidity sensor. The seam shape calculator determines the position and shape of a seam between a plurality of images on the basis of an index of inconspicuous to human eyes, in panorama printing where a panoramic image longer than a specified printing size is divided into the images as small as or smaller than the printing size, and is printed multiple times so that the images are joined to each other. The controller controls a printing medium, an ink ribbon, and the thermal head so that the images divided based on the position and shape of the seam, determined by the seam shape calculator, are thermally transferred onto a plurality of respective continuous regions of the printing medium using a plurality of unit printing regions of the ink ribbon, so as to be joined together. The temperature sensor measures the temperature of the thermal head. The temperature-and-humidity sensor measures the temperature and humidity of the inside of the thermal printer. The seam shape calculator calculates a coloring property of the ink that has been thermally transferred onto the printing medium, on the basis of the temperature of the thermal head, measured by the temperature sensor, and on the basis of the temperature and humidity of the inside of the thermal printer, measured by the temperature-and-humidity sensor. The seam shape calculator determines the position and shape of the seam on the basis of the coloring property and a gradation component of the panoramic image.

Another aspect of the present invention provides a method for controlling a thermal printer that performs printing by thermally transferring an ink of an ink ribbon onto a printing medium using a thermal head. The ribbon includes a plurality of unit printing regions each provided with the ink in a unit of a specified printing size. The method includes the following steps: a first step of determining the position and shape of a seam between a plurality of images on the basis of an index of inconspicuousness to human eyes, in panorama printing where a panoramic image longer than the printing size is divided into the plurality of images as small as or smaller than the printing size, and is printed a plurality of times so that the plurality of images are joined to each other; a second step of controlling the printing medium, the ink ribbon, and the thermal head so that the plurality of images divided based on the position and shape of the seam, determined in the first step, are thermally transferred onto a plurality of respective continuous regions of the printing medium using the plurality of unit printing regions of the ink ribbon, so as to be joined to each other; a third step of measuring the temperature of the thermal head; and a fourth step of measuring the temperature and humidity of the inside of the thermal printer. The first step includes the following steps: calculating a coloring property of the ink that has been thermally transferred onto the printing medium, on the basis of the temperature of the thermal head, measured in the third step, and on the basis of the temperature and humidity of the inside of the thermal printer, measured in the fourth step; and determining the position and shape of the seam on the basis of the coloring property and a gradation component of the panoramic image.

Effects of the Invention

According to the aspects of the present invention, the position and shape of the seam between the images are determined based on the index of inconspicuousness to human eyes. Thus, the seam in panorama printing is inconspicuous to human eyes. This improves image quality in panorama printing.

These and other objects, features, aspects and advantages of the Description will become more apparent from the following detailed description of the Description when taken in conjunction with the accompanying drawings.

DESCRIPTION OF EMBODIMENT(S)

For detailed description of the present invention, embodiments of the present invention will be described with reference to the accompanying drawings.

First Embodiment

A first embodiment deals with a thermal printer that divides a stored panoramic image into two images for panorama printing. The first embodiment describes how to divide the panoramic image, and to print the panoramic image.

Figure 1:
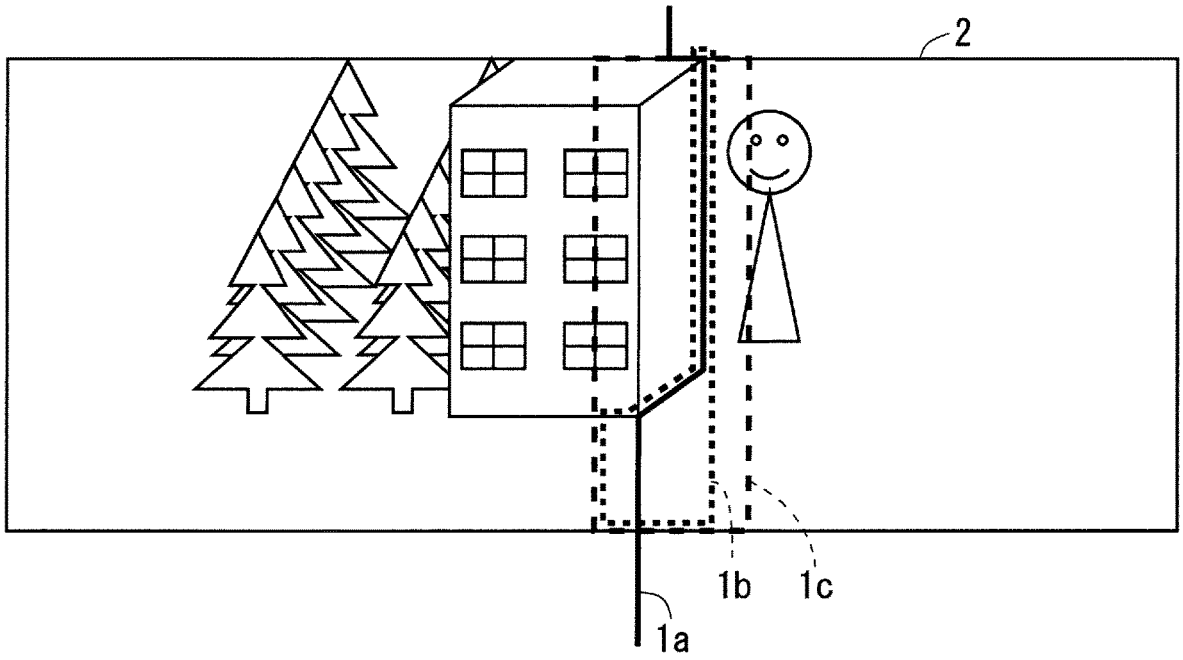
FIG. 1 is a diagram illustrating a printed panoramic object supplied from a thermal printer according to a first embodiment.
Figure 2:
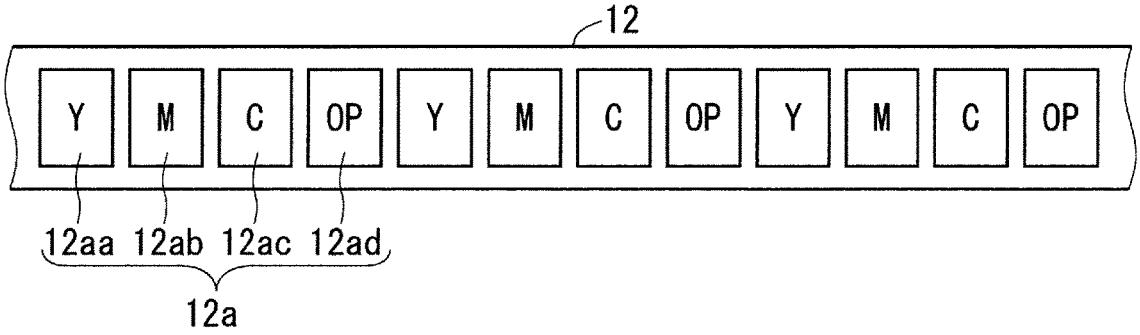
FIG. 2 is a diagram illustrating an ink ribbon included in the thermal printer according to the first embodiment.

FIG. 1 is a diagram illustrating one example of a printed panoramic object 2, which consists of a printed panoramic image, supplied from a thermal printer 11A according to the first embodiment of the present invention. FIG. 2 is a diagram illustrating one example of the configuration of an ink ribbon 12 included in the thermal printer 11A according to the first embodiment.

The ink ribbon 12 in the example in FIG. 2 has a plurality of unit printing regions 12*a*. Each unit printing region 12*a* has three colors of coloring inks 12*aa* to 12*ac* of specified size: yellow (Y), magenta (M), and cyan (C), and has a protective ink (called OP; this ink is also referred to as a protective layer) 12*ad*. The protective ink 12*ad* is thermally transferred onto the coloring inks 12*aa* to 12*ac* that have been thermally transferred onto a printing medium, and the protective ink 12*ad* protects the coloring inks 12*aa* to 12*ac* as thermally transferred. The inks 12*aa* to 12*ad* are arranged in the vertical scanning direction in this order. In typical printing, a single printed object is produced by thermally transferring the single, unit printing region 12*a*, i.e., the four inks 12*aa* to 12*ad*, onto a printing medium.

In panorama printing, a panoramic image longer in the vertical scanning direction than the printing size of the ink ribbon 12, i.e., the individual sizes of the inks 12*aa* to 12*ad*, is divided into a plurality of images as small as or smaller than the printing size, and is then printed. In the example in FIG. 1, the single, printed panoramic object 2 is printed in the following manner: A panoramic image is divided into two images; then, the panoramic image is printed so that the divided images anterior to and posterior to a seam 1*a* partly overlap each other in an overlap region 1*b* to be thus joined together.

Configuration of Thermal Printer

Figure 3:
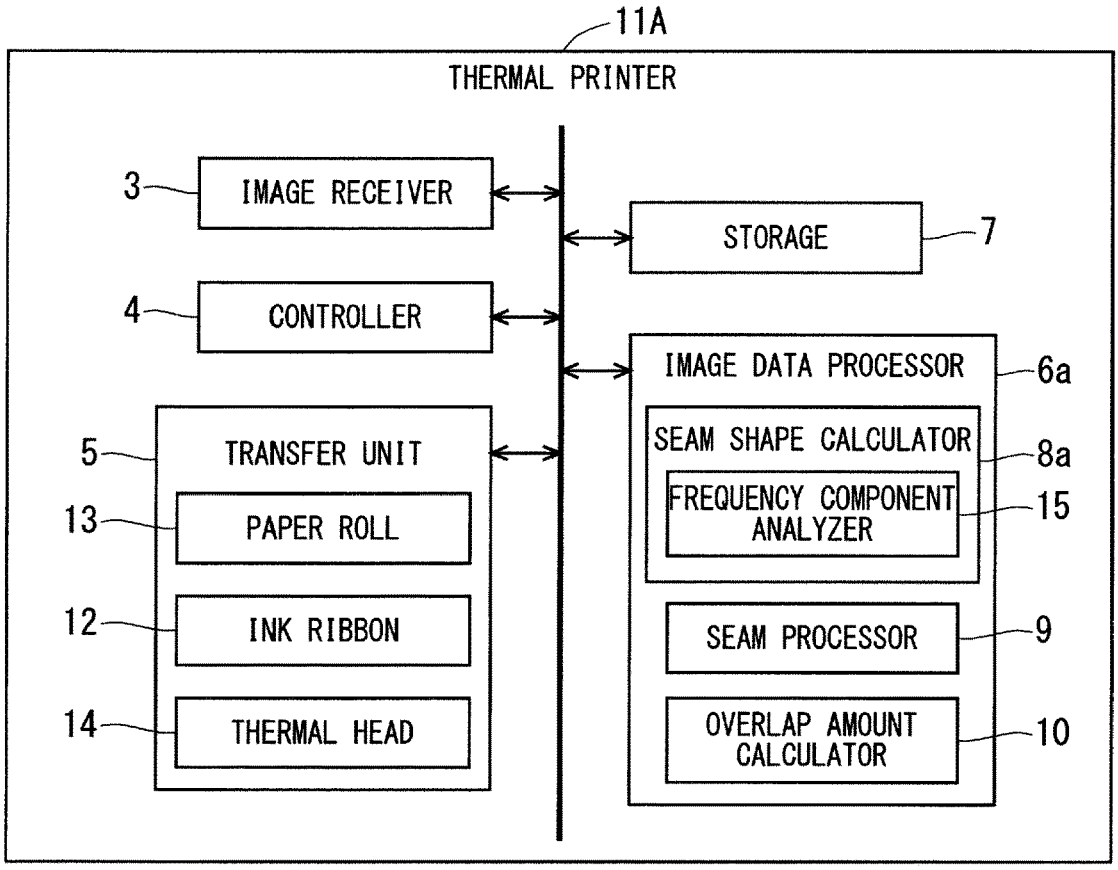
FIG. 3 is a block diagram illustrating the configuration of the thermal printer according to the first embodiment.

FIG. 3 is a diagram illustrating one example of the configuration of the thermal printer 11A according to the first embodiment. As illustrated in FIG. 3, the thermal printer 11A includes an image receiver 3, a storage 7, an image data processor 6*a*, a controller 4, and a transfer unit 5.

The image receiver 3 receives an image data piece to be printed by the thermal printer 11A. The image receiver 3 receives the image data piece via, for instance, a universal-serial-bus (USB) memory or a memory card, or via a wire or wireless network.

Examples of the storage 7 include a non-volatile or volatile semiconductor memory (e.g., a RAM, a ROM, a flash memory, an EPROM, or an EEPROM), a magnetic disc, a flexible disc, an optical disc, a compact disc, a mini disc, and a DVD.

The storage 7 stores programs for controlling the individual components of the thermal printer 11A, the image data piece received by the image receiver 3, and other things. Examples of the stored programs include a program to determine the position and shape of the seam 1*a* in panorama printing, and a program to process the image data piece, such as a program to correct the seam 1*a* for image quality improvement at the seam 1*a*. The details will be described later on.

The image data processor 6*a* processes the image data piece stored in the storage 7 in various ways. The image data processor 6*a* includes a seam shape calculator 8*a* having a frequency component analyzer 15, and includes an overlap amount calculator 10 and a seam processor 9. The function of each of the seam shape calculator 8*a*, the overlap amount calculator 10, and the seam processor 9 is implemented by the image data processor 6*a*.

The seam shape calculator 8*a* analyzes, in the frequency component analyzer 15, a frequency component in an analysis region 1*c*. The analysis region 1*c* is a predetermined region in the image data piece received by the image receiver 3. The seam shape calculator 8*a* also determines the position and shape of the seam 1*a* in panorama printing of the image data piece, on the basis of the result of the frequency component analysis in the frequency component analyzer 15.

The overlap amount calculator 10 determines the overlap region 1*b*, in which the images anterior to and posterior to the seam 1*a*, determined by the seam shape calculator 8*a*, overlap each other at the seam 1*a*. The seam processor 9 performs correction on the seam 1*a*. That is, the seam processor 9 corrects the concentrations of the images anterior to and posterior to the seam 1*a* in the overlap region 1*b* in order to improve image quality at the seam 1*a*, determined by the seam shape calculator 8*a*. These operations in the image data processor 6*a* will be detailed later on.

The controller 4 controls each component of the thermal printer 11A. For instance, the controller 4 controls a motor (not shown) and a sensor (not shown) to move the ink ribbon 12 and a paper roll 13 (i.e., printing medium), and controls a thermal head 14 to control printing that is performed by the transfer unit 5.

The transfer unit 5 includes the ink ribbon 12, the paper roll 13 (i.e., printing medium), and the thermal head 14. Under the control of the controller 4, the transfer unit 5 prints the image data piece that has been processed by the image data processor 6*a* by thermally transferring, with the thermal head 14, the inks 12*aa* to 12*ad* of the ink ribbon 12 onto the paper roll 13.

It is noted that the image data processor 6*a* and the controller 4 may be dedicated hardware or a central processing unit (CPU for short; also referred to as a processing unit, a calculator, a microprocessor, a microcomputer, a processor, or a DSP) to execute the programs stored in the storage 7.

When the image data processor 6*a* and the controller 4 are dedicated hardware, examples of the image data processor 6*a* and the controller 4 include a single circuit, a complex circuit, a programmed processor, a parallel-programmed processor, an ASIC, an FPGA, and a combination thereof.

When the image data processor 6*a* is a CPU, the function of each of the seam shape calculator 8*a*, the overlap amount calculator 10, and the seam processor 9 is implemented by software, firmware, or a combination of software and firmware. The software and the firmware are written as programs and stored in the storage 7. The image data processor 6*a* reads and executes the programs stored in the storage 7, thus implementing the function of each of the seam shape calculator 8*a*, the overlap amount calculator 10, and the seam processor 9. These programs cause a computer to execute the procedures or methods in the seam shape calculator 8*a*, the overlap amount calculator 10, and the seam processor 9.

The controller 4, when being a CPU, reads and executes the programs stored in the storage 7, thus implementing the function of controlling each component of the thermal printer 11A.

It is noted that part of the functions of the image data processor 6*a* and the controller 4 may be implemented by dedicated hardware, and different part of them may be implemented by software or firmware.

Operation of Thermal Printer

The thermal printer 11A stores, in the storage 7, the image data piece of the panoramic image received by the image receiver 3. The thermal printer 11A then divides the panoramic image for panorama printing of the image data piece.

Figure 4:
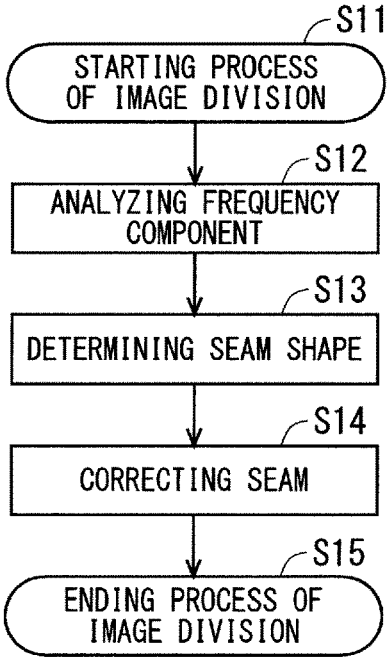
FIG. 4 is a flowchart showing dividing of a panoramic image that is performed in the thermal printer according to the first embodiment.

FIG. 4 is a flowchart showing dividing of the panoramic image that is performed in the thermal printer 11A according to the first embodiment of the present invention. As shown in FIG. 4, in step S11, the panoramic image starts to undergo image division.

Next, in step S12, the frequency component analyzer 15 analyzes the frequency component (also referred to as a "spatial frequency") in the analysis region 1*c*, which is a predetermined region for determining the position and shape of the seam 1*a* of the panoramic image. The position and range of the analysis region 1*c*, although not defined herein, are set so that the divided images each have a size equal to or less than a printing size; the maximum size is the same as the printing size.

The frequency component analyzer 15 analyzes the frequency component in the analysis region 1*c* of the panoramic image through, for instance, two-dimensional Fourier transformation or discrete cosine transformation. It is noted that any method other than these methods may be used to analyze the frequency component of the image.

Next, in step S13, the seam shape calculator 8*a* determines the position and shape of the seam 1*a* in panorama printing on the basis of the result of the frequency component analysis in step S12. In this embodiment, the seam shape calculator 8*a* determines the position and shape of the seam 1*a* in panorama printing, using the height of the frequency component analyzed in step S12 as an index of inconspicuousness to human eyes.

Since an image varies slightly at a portion where the image has many low-frequency components, establishing the seam 1*a* in such a position and performing panorama printing render the seam 1*a* conspicuous to the human eyes. Meanwhile, since the image varies greatly at a portion where the image has many high-frequency components, establishing the seam 1*a* having a shape along such a portion and performing panorama printing render the seam 1*a* inconspicuous to the human eyes. The seam shape calculator 8*a* determines the position and shape of the seam 1*a* along, for instance, a portion having the highest spatial frequency in the vertical scanning direction in the analysis region 1*c*.

Here, the seam shape calculator 8*a* determines the position and shape of the seam 1*a* for all of the Y coloring ink 12*aa*, the M coloring ink 12*ab*, and the C coloring ink 12*ac*, for instance. This determination renders the seam 1*a* inconspicuous when compared to determination of the position and shape of the seam 1*a* for a single color of an ink. It is noted that for instance, the seam shape calculator 8*a* may determine the position and shape of the seam 1*a* for one of the coloring inks 12*aa* to 12*ac*, and establish the same position and shape of the seam 1*a* for the individual inks. Such determination reduces the amount of the processing in the seam shape calculator 8*a*.

Next, in step S14, the image data processor 6*a* performs correction of the seam 1*a* with respect to the images divided based on the position and shape of the seam 1*a*, determined in step S13. To be specific, the overlap amount calculator 10 determines the overlap region 1*b* at the seam 1*a* between the images divided based on the position and shape of the seam 1*a*, determined in step S13. Then, the seam processor 9 corrects the concentrations of the images anterior to and posterior to the seam 1*a* in the overlap region 1*b*, determined by the overlap amount calculator 10. This seam correction is performed with a method described in, for instance, Patent Document 1. It is noted that the seam correction may be performed with any method other than that described in Patent Document 1.

Subsequently, the controller 4 controls the transfer unit 5 to perform panorama printing. To be specific, the controller 4 controls the transfer unit 5 so that the images divided based on the position and shape of the seam 1*a*, determined in step S13, are thermally transferred onto a plurality of respective continuous regions of the paper roll 13 using the plurality of unit printing regions 12*a* of the ink ribbon 12, so as to be joined to each other. At this time, the controller 4 controls the transfer unit 5 so that the images anterior to and posterior to the seam 1*a* with their concentrations corrected by the seam processor 9 overlap each other in the overlap region 1*b*, determined by the overlap amount calculator 10. This produces the printed panoramic object 2 illustrated in FIG. 1.

Here, the position and shape of the seam 1*a* for the protective ink 12*ad* is different from the position and shape of the seam 1*a* for the coloring inks 12*aa* to 12*ac* determined in step S13. Printing the protective ink 12*ad* in complex form can fail in detachment. Accordingly, the protective ink 12*ad* alone, for instance, is linearly printed at a location away from the seam 1*a* for the coloring inks 12*aa* to 12*ac*.

Furthermore, the coloring inks 12*aa* to 12*ac* cannot be thermally transferred onto where the protective ink 12*ad* has been thermally transferred so as to be superposed upon the protective ink 12*ad*. Accordingly, the position of the seam 1*a* for the protective ink 12*ad* is established so that the coloring inks 12*aa* to 12*ac* to be thermally transferred onto a portion posterior to the seam 1*a* are not superposed upon the protective ink 12*ad* to be transferred onto a portion anterior to the seam 1*a*. In some cases, the four inks 12*aa* to 12*ad* undergo thermal transfer in the order of Y→M→C→Y→M→C→OP→OP; that is, the coloring inks 12*aa* to 12*ac* are thermally transferred, followed by the protective ink 12*ad*. In these cases, printing may be performed so that the seam for the protective ink 12*ad* is over the seam 1*a* for the coloring inks 12*aa* to 12*ac*.

The thermal printer 11A according to the present embodiment does not, like a conventional thermal printer, divide the panoramic image so that the seam 1*a* of the panoramic image always has a linear shape. Rather, the seam shape calculator 8*a* determines the position and shape of the seam 1*a* on the basis of the index of inconspicuousness to human eyes. Consequently, the thermal printer 11A establishes the seam 1*a* that is inconspicuous to human eyes. This improves image quality in panorama printing.

The seam shape calculator 8*a* determines the position and shape of the seam 1*a* on the basis of the frequency component of the image analyzed by the frequency component analyzer 15. This establishes, in panorama printing, the seam 1*a* having a shape along a portion where the pattern of the image varies greatly, i.e., a portion inconspicuous to human eyes.

Second Embodiment

In the first embodiment, the position and shape of the seam 1*a* in panorama printing are determined based on the frequency component of a panoramic image. In a second embodiment of the present invention, this determination is performed based on a gradation component of the panoramic image.

Figure 5:
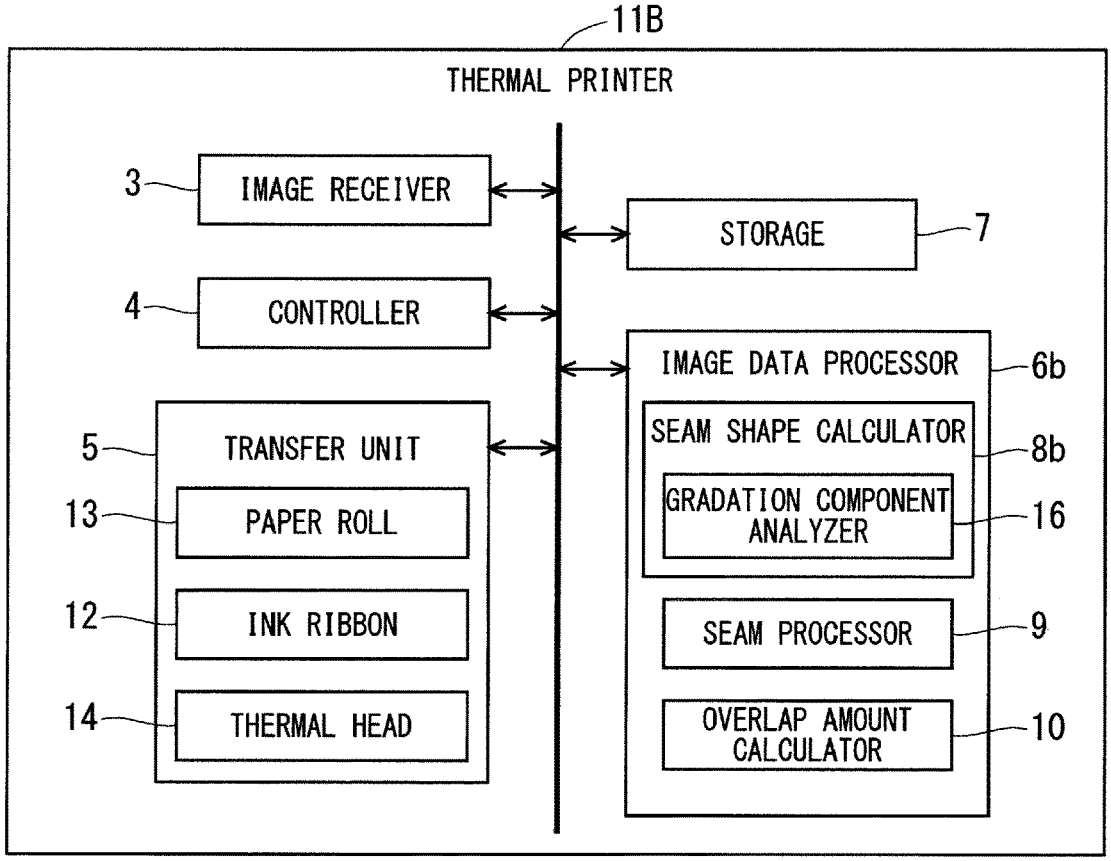
FIG. 5 is a block diagram illustrating the configuration of a thermal printer according to a second embodiment.

FIG. 5 is a block diagram illustrating one example of the configuration of a thermal printer 11B according to the second embodiment of the present invention. As illustrated in FIG. 5, the thermal printer 11B includes an image data processor 6*b* instead of the image data processor 6*a*, which is included in the thermal printer 11A in FIG. 3. Identical components between the first and second embodiments are denoted by the same sings, and will not be elaborated upon.

The image data processor 6*b* processes an image data piece stored in the storage 7 in various ways. The image data processor 6*b* includes a seam shape calculator 8*b* having a gradation component analyzer 16, and includes the overlap amount calculator 10, and the seam processor 9. The function of each of the seam shape calculator 8*b*, the overlap amount calculator 10, and the seam processor 9 is implemented by the image data processor 6*b*. It is noted that the image data processor 6*b*, like the image data processor 6*a*, may be dedicated hardware or a CPU to execute programs stored in the storage 7.

Figure 6:
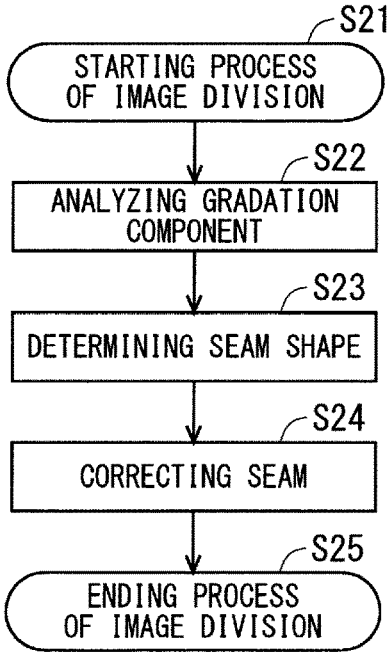
FIG. 6 is a flowchart showing dividing of a panoramic image that is performed in the thermal printer according to the second embodiment.

FIG. 6 is a flowchart showing division of the panoramic image that is performed in the thermal printer 11B according to the second embodiment of the present invention. Steps S21, S24, and S25 in FIG. 6, which are similar to steps S11, S14, and S15 in FIG. 4 described in the first embodiment, will not be elaborated upon.

As shown in FIG. 6, step S22 is executed after step S21, where image division starts. In step S22, the seam shape calculator 8*b* analyzes, in the gradation component analyzer 16, the gradation component of the image in the analysis region 1*c*.

Next, in step S23, the seam shape calculator 8*b* determines the position and shape of the seam 1*a* in panorama printing on the basis of the result of the gradation component analysis in step S22. In this embodiment, the seam shape calculator 8*b* determines the position and shape of the seam 1*a* in panorama printing, using the degree of variation in the gradation component analyzed in step S22 as an index of inconspicuousness to human eyes.

The seam 1*a* is typically conspicuous to human eyes when established at a portion where the gradation of an image varies slightly and where the image is uniform. The seam 1*a*, on the other hand, is inconspicuous to human eyes when established, for panorama printing, so as to have a shape along a portion where the gradation of the image varies greatly. The seam shape calculator 8*b* determines the position and shape of the seam 1*a* along, for instance, a site where the gradation in the vertical scanning direction varies to the highest degree in the analysis region 1*c*.

In the thermal printer 11B according to the present embodiment, the seam shape calculator 8*b* determines the position and shape of the seam 1*a* on the basis of the gradation component of the image analyzed by the gradation component analyzer 16. This establishes, in panorama printing, the seam 1*a* having a shape along a portion where the image is non-uniform, i.e., a portion inconspicuous to human eyes.

Third Embodiment

In the second embodiment, the position and shape of the seam 1*a* in panorama printing are determined based on the gradation component of an image. In a third embodiment of the present invention, this determination is performed based on the result of analysis of tailing.

Here, "tailing" is a phenomenon that occurs when a thermal printer prints an image having a region with very high concentration and a region with very low concentration in such a manner that the high-concentration region is printed first, followed by the low-concentration region. Such an image after printed has a portion with a dark color rubbed, spreading in the low-concentration region. This portion exhibits tailing. When the seam 1*a* in panorama printing is established at a portion exhibiting tailing, the seam 1*a* is conspicuous to human eyes.

Figure 7:
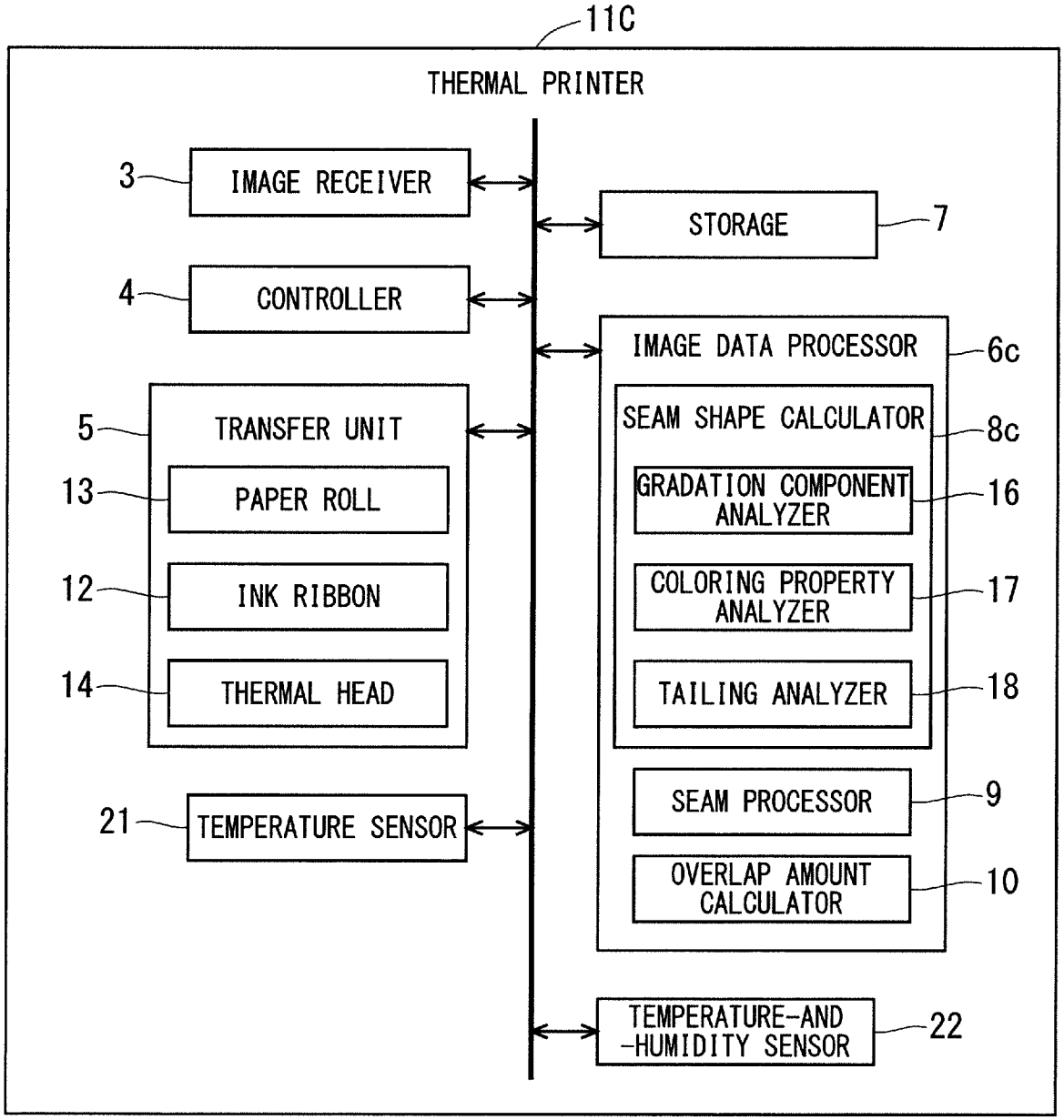
FIG. 7 is a block diagram illustrating the configuration of a thermal printer according to a third embodiment.

FIG. 7 is a block diagram illustrating one example of the configuration of a thermal printer 11C according to the third embodiment of the present invention. As illustrated in FIG. 7, the thermal printer 11C according to the third embodiment further includes a temperature sensor 21 and a temperature-and-humidity sensor 22 in addition to the components of the thermal printer 11B in FIG. 5. The thermal printer 11C also includes an image data processor 6*c* instead of the image data processor 6*b*. Identical components between the third embodiment and the first and second embodiments are denoted by the same sings, and will not be elaborated upon.

The temperature sensor 21 measures the temperature of the thermal head 14. The temperature-and-humidity sensor 22 measures the temperature and humidity of the inside of the thermal printer 11C.

The image data processor 6*c* includes a seam shape calculator 8*c* having the gradation component analyzer 16, a coloring property analyzer 17, and a tailing analyzer 18, and includes the overlap amount calculator 10 and the seam processor 9. The function of each of the seam shape calculator 8*c*, the overlap amount calculator 10, and the seam processor 9 is implemented by the image data processor 6*c*. It is noted that the image data processor 6*c*, like the image data processors 6*a* and 6*b*, may be dedicated hardware or a CPU to execute programs stored in the storage 7.

Figure 8:
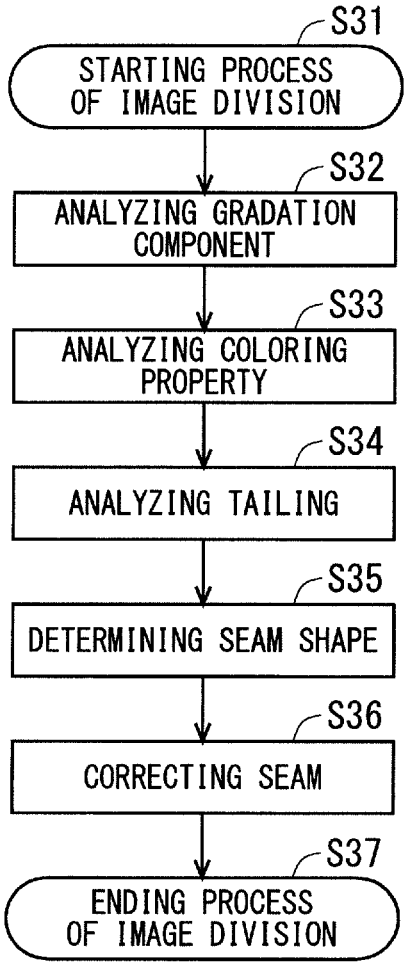
FIG. 8 is a flowchart showing dividing of a panoramic image that is performed in the thermal printer according to the third embodiment.

FIG. 8 is a flowchart showing division of a panoramic image the is performed in the thermal printer 11C according to the third embodiment of the present invention. Steps S31, S32, S36, and S37 in FIG. 8, which are similar to steps S21, S22, S24, S25 in FIG. 6 described in the second embodiment, will not be elaborated upon.

As shown in FIG. 8, step S32 is executed after step S31, where image division starts. In step S32, the seam shape calculator 8*c* analyzes, in the gradation component analyzer 16, the gradation component of the image in the analysis region 1*c*.

Next, in step S33, the seam shape calculator 8*c* analyzes, in the coloring property analyzer 17, the coloring properties of the coloring inks 12*aa* to 12 that have been thermally transferred onto the paper roll 13, on the basis of the temperature and humidity of the inside of the thermal printer 11C, measured by the temperature-and-humidity sensor 22, and on the basis of the result of the measurement in the temperature sensor 21, the result indicating the temperature of the thermal head 14.

Next, in step S34, the seam shape calculator 8*c* analyzes, in the tailing analyzer 18, tailing in an image, on the basis of the result of the gradation component analysis in step S32 and the result of the coloring property analysis in step S33. The tailing analyzer 18 determines that a site where the gradation component of the image varies from high gradation to low gradation in the vertical scanning direction, for instance, is likely to exhibit tailing.

In step S35, the seam shape calculator 8*c* determines the position and shape of the seam 1*a* in panorama printing on the basis of the result of the tailing analysis in step S34. In this embodiment, the seam shape calculator 8*c* determines the position and shape of the seam 1*a* in panorama printing, using the smallness of the amount of tailing analyzed in step S34 as an index of inconspicuousness to human eyes.

Establishing the seam 1*a* at a portion with a large amount of tailing renders the seam 1*a* conspicuous to human eyes. On the other hand, establishing, for panorama printing, the seam 1*a* having a shape along a site with a small amount of tailing renders the seam 1*a* inconspicuous to human eyes. The seam shape calculator 8*c* determines the position and shape of the seam 1*a* in panorama printing along, for instance, a site with the smallest amount of tailing in the analysis region 1*c*.

In the thermal printer 11C according to the present embodiment, the seam shape calculator 8*c* determines the position and shape of the seam 1*a* on the basis of the tailing in the image analyzed by the tailing analyzer 18. This establishes, in panorama printing, the seam 1*a* having a shape along a site with a small amount of tailing, i.e., a site inconspicuous to human eyes.

It is noted that, in the individual embodiments, the amount of overlap in the overlap region 1*b* for each of the coloring inks 12*aa* to 12*ac* may be determined in a manner similar to that in conventional seam correction; that is, the amount of overlap may be predetermined so that the ends of the overlap region 1*b* for the individual coloring inks 12*aa* to 12*ac* do not overlap each other. Alternatively, the amount of overlap may be determined in a manner similar to that in the present invention; that is, the amount of overlap may be determined based on the index of inconspicuousness to human eyes.

For instance, let the amount of overlap in the overlap region 1*b* for each of the coloring inks 12*aa* to 12*ac* be determined using the degree of the frequency component as the index of inconspicuousness to human eyes. Accordingly, the overlap region 1*b* may be determined so that the ends of the overlap region 1*b* are located at a portion along a position where the frequency component is the highest in a predetermined region away, by a predetermined distance, from the seam 1*a* between the images anterior to and posterior to the seam 1*a*. In this case, the overlap region 1*b* is determined so that the ends of the overlap region 1*b* for the individual coloring inks 12*aa* to 12*ac* do not overlap each other. This enables the seam 1*a* to be more inconspicuous to human eyes.

It is noted that in the present invention, the individual embodiments can be freely combined, or can be modified and omitted as appropriate, within the scope of the invention.

While the invention has been shown and described in detail, the foregoing description is in all aspects illustrative and not restrictive. It is therefore understood that numerous modifications and variations can be devised without departing from the scope of the invention.

EXPLANATION OF REFERENCE SIGNS

1*a* seam, 1*b* overlap region, 1*c* analysis region, 2 printed panoramic object, 3 image receiver, 4 controller, 5 transfer unit, 6*a* to 6*c* image data processor, 7 storage, 8*a* to 8*c* seam shape calculator, 9 seam processor, 10 overlap amount calculator, 11A to 11C thermal printer, 12 ink ribbon, 12*a* unit printing region, 12*aa* to 12*ac* coloring ink, 12*ad* protective ink, 13 paper roll (printing medium), 14 thermal head, 15 frequency component analyzer, 16 gradation component analyzer, 17 coloring property analyzer, 18 tailing analyzer, 21 temperature sensor, 22 temperature-and-humidity sensor.

The invention claimed is:

1. A thermal printer for printing by thermally transferring an ink of an ink ribbon onto a printing medium using a thermal head, the ribbon including a plurality of unit printing regions each provided with the ink in a unit of a specified printing size, the thermal printer comprising:

a seam shape calculator configured to determine a position and a shape of a seam between a plurality of images on the basis of an index of inconspicuousness to human eyes, in panorama printing where a panoramic image longer than the printing size is divided into the plurality of images as small as or smaller than the printing size, and is printed a plurality of times so that the plurality of images are joined to each other;

a controller configured to control the printing medium, the ink ribbon, and the thermal head so that the plurality of images divided based on the position and shape of the seam, determined by the seam shape calculator, are thermally transferred onto a plurality of respective continuous regions of the printing medium using the plurality of unit printing regions of the ink ribbon, so as to be joined to each other;

a temperature sensor configured to measure a temperature of the thermal head; and a temperature-and-humidity sensor configured to measure a temperature and a humidity of an inside of the thermal printer, wherein the seam shape calculator calculates a coloring property of the ink that has been thermally transferred onto the printing medium, on the basis of the temperature of the thermal head, measured by the temperature sensor, and on the basis of the temperature and humidity of the inside of the thermal printer, measured by the temperature-and-humidity sensor, and the seam shape calculator determines the position and shape of the seam on the basis of the coloring property and a gradation component of the panoramic image.

2. The thermal printer according to claim 1, further comprising:

an overlap amount calculator configured to determine an overlap region in the plurality of images anterior to and posterior to the seam, the seam being determined by the seam shape calculator; and a seam processor configured to correct concentrations of the plurality of images anterior to and posterior to the seam in the overlap region, determined by the overlap amount calculator, wherein the controller controls the printing medium, the ink ribbon, and the thermal head so that the plurality of images anterior to and posterior to the seam with the concentrations being corrected by the seam processor overlap each other in the overlap region, determined by the overlap amount calculator.

3. The thermal printer according to claim 1, wherein the seam shape calculator calculates tailing in the panoramic image that has been printed, on the basis of the coloring property and the gradation component, and the seam shape calculator determines the position and shape of the seam along a position where the tailing in a length direction of the panoramic image are the fewest in a predetermined region of the panoramic image, the predetermined region being used for determining the position and shape of the seam.

4. The thermal printer according to claim 1, wherein the plurality of unit printing regions each comprise a plurality of colors of inks, and the seam shape calculator determines the position and shape of the seam for each of the plurality of colors of inks.

5. The thermal printer according to claim 1, wherein the plurality of unit printing regions each comprise a coloring ink and a protective ink, the protective ink being thermally transferred onto the coloring ink that has been thermally transferred onto the printing medium, the protective ink serving as a protective layer that protects the coloring ink, and the controller controls the printing medium, the ink ribbon, and the thermal head so that the plurality of images are printed using the coloring ink, and that the protective ink is thermally transferred without the seam for the protective ink overlapping the seam for the coloring ink.

6. The thermal printer according to claim 5, wherein the seam for the protective ink has a linear shape.

7. A method for controlling a thermal printer for printing by thermally transferring an ink of an ink ribbon onto a printing medium using a thermal head, the ribbon including a plurality of unit printing regions each provided with the ink in a unit of a specified printing size, the method comprising:

a first step of determining a position and a shape of a seam between a plurality of images on the basis of an index of inconspicuousness to human eyes, in panorama printing where a panoramic image longer than the printing size is divided into the plurality of images as small as or smaller than the printing size, and is printed a plurality of times so that the plurality of images are joined to each other;

a second step of controlling the printing medium, the ink ribbon, and the thermal head so that the plurality of images divided based on the position and shape of the seam, determined in the first step, are thermally transferred onto a plurality of respective continuous regions of the printing medium using the plurality of unit printing regions of the ink ribbon, so as to be joined to each other;

a third step of measuring a temperature of the thermal head; and a fourth step of measuring a temperature and a humidity of an inside of the thermal printer, wherein the first step comprises calculating a coloring property of the ink that has been thermally transferred onto the printing medium, on the basis of the temperature of the thermal head, measured in the third step, and on the basis of the temperature and humidity of the inside of the thermal printer, measured in the fourth step, and determining the position and shape of the seam on the basis of the coloring property and a gradation component of the panoramic image.

8. The method according to claim 7, further comprising:

a fifth step of determining an overlap region in the plurality of images anterior to and posterior to the seam, the seam being determined in the first step, the fifth step being performed between the first and second steps; and a sixth step of correcting concentrations of the plurality of images anterior to and posterior to the seam in the overlap region, determined in the fifth step, the sixth step being performed between the first and second steps, wherein the second step comprises controlling the printing medium, the ink ribbon, and the thermal head so that the plurality of images anterior to and posterior to the seam with the concentrations being corrected in the sixth step overlap each other in the overlap region, determined in the fifth step.

9. The method according to claim 7, wherein the plurality of unit printing regions each comprise a plurality of colors of inks, and the first step comprises determining the position and shape of the seam for each of the plurality of colors of inks.

10. The method according to claim 7, wherein the plurality of unit printing regions each comprise a coloring ink and a protective ink, the protective ink being thermally transferred onto the coloring ink that has been thermally transferred onto the printing medium, the protective ink serving as a protective layer that protects the coloring ink, and the second step comprises controlling the printing medium, the ink ribbon, and the thermal head so as to print the plurality images by thermally transferring the coloring ink, and to thermally transfer the protective ink without the seam for the protective ink overlapping the seam for the coloring ink.

11. The method according to claim 10, wherein the seam for the protective ink has a linear shape.

* * * * *